US005344620A

United States Patent [19]

Reiners et al.

[11] Patent Number: 5,344,620

[45] Date of Patent: Sep. 6, 1994

[54] PIGMENT PRINTING ON FIBRE MATERIALS

[75] Inventors: Jürgen Reiners; Herbert Wigger, both of Leverkusen; Fritz Puchner, Cologne, all of Fed. Rep. of Germany

[73] Assignee: Bayer Aktiengesellschaft, Leverkusen, Fed. Rep. of Germany

[21] Appl. No.: 821,211

[22] Filed: Jan. 16, 1992

[30] Foreign Application Priority Data

Jan. 23, 1991 [DE] Fed. Rep. of Germany ..... 4101822

[51] Int. Cl.[5] ..... B05D 5/00

[52] U.S. Cl. ..... 427/288; 106/19 F; 8/115.51; 8/115.6; 8/116.1; 8/181; 8/188; 8/189; 8/196; 8/194; 427/392; 428/195; 428/264; 525/180; 525/181; 525/430; 525/435

[58] Field of Search ..... 525/180, 181, 430, 435; 106/23, 19 F; 428/19.5, 264; 427/288, 392; 8/115.51, 115.6, 116.1, 181, 188, 189, 194, 196

[56] References Cited

U.S. PATENT DOCUMENTS 3,700,623 10/1972 Keim ..... 525/328.3
3,932,363 1/1976 Lehmann et al. ..... 162/164
4,975,499 12/1990 Bachem et al. ..... 525/435
5,082,527 1/1992 Bachem et al. ..... 162/164.3
5,093,470 3/1992 Bachem et al. ..... 528/407

FOREIGN PATENT DOCUMENTS 0335158 10/1989 European Pat. Off. .

OTHER PUBLICATIONS

Database WPIL, Section Ch, Week 8634, Dec. 27, 1984, Derwent Publications Ltd., London, GB, Class A, AN 222138 & JP-A-61 152 900 (Arakawa Kagaku Kogyo).

*Primary Examiner*—Judy M. Reddick
*Attorney, Agent, or Firm*—Sprung Horn Kramer & Woods

[57] ABSTRACT

Water-soluble crosslinkable compounds obtainable by reaction of reactive products which contain halogenohydrin groups and have been obtained by reacting polyamines and epihalogenohydrin or 1,3-dihalogeno-2-hydroxy-propane with inorganic bases and subsequently reacting the resulting products with inorganic acids and/or organic acids, can be used as pigment binders and/or crosslinking agents in textile printing pastes.

18 Claims, No Drawings

PIGMENT PRINTING ON FIBRE MATERIALS

The invention relates to a process for pigment printing on fibre materials.

In pigment printing on fibre materials, pigments are fixed to the fibre with particular binders, preferably by a the final condensation operation. The fastness properties of these prints are not only determined by the pigments but are also dependent on the nature of the binder and on the completeness of the condensation process. The binder can also influence the handle of the goods. Undesirable induration may occur here.

The storage life and stability of the binder is furthermore important.

Polyureas of diisocyanates and diprimary aliphatic diamines are known from German Patent Specification 851,550. These products have proved to be outstanding binders for pigment printing. A disadvantage is, however, that the products are of limited storage life, which manifests itself in a reduction in the viscosity and a corresponding decrease in the fastness of the prints.

Binders which are distinguished by an improved storage life and which, when used, lead to prints which have a soft handle, especially on textiles, are described in German Offenlegungsschrift 3,914,047. Polyamides of adipic acid and diethylenetriamine are proposed as binders.

It is furthermore known to use a crosslinking agent together with the binder.

Suitable crosslinking agents are compounds which can react with the polyamide to give crosslinked structures. Such crosslinking agents are known%, for example, from German Patent Specification 936,328: a preferred group of crosslinking agents comprises condensation products of epihalogenohydrin (epichloro- or epibromohydrin) and diprimary aliphatic amines, for example bis-(3-aminopropyl)-methylamine or bis-(3-aminopropyl)-amine.

Such a crosslinking agent contains, for example, the following structural unit:

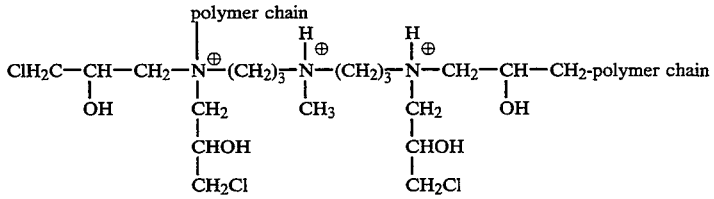

Reaction products which are obtained from polyamines with epichlorohydrin or 1,3-dihalogeno-2-hydroxy-propane and contain halogenohydrin groups are known.

Self-crosslinking, water-soluble reaction products of epihalogenohydrins and basic polyamidoamines or polyamines or mixtures thereof, in each case an excess of epihalogenohydrin per equivalent of free basic amino groups being used, are thus described, for example, in German Offenlegungsschriften 2,229,219, 2,257,271, 2,938,588 and 2,949,870, German Patent Specifications 1,720,905, 1,771,043 and 1,906,450, European Patent Applications 0,131,200 and 0,126,176 and U.S. Pat. Nos. 2,926,154, 3,224,990 and 3,332,901. Similar resins which are obtained by reaction of basic polyamidoamines with glycerol-dichlorohydrin are described in German Offenlegungsschrift 1,696,248.

According to another known process of German Offenlegungsschrift 2,052,023, water-soluble, hardenable resins are obtained by reaction of epichlorohydrin with ammonia and/or polyamines.

Polycondensates of ammonia and epichlorohydrin are described in German Offenlegungsschrift 2,364,583 and U.S. Pat. No. 3,947,383.

Crosslinkable resins which have been employed in practice to date and are described by the previous literature cited in general contain 1.0 to 2.5 mol of epihalogenohydrin, based on the basic nitrogen in the polyamine.

The products have a detectably high content of halogenohydrin reactive groups; these are necessary in order to obtain sufficiently crosslinkable, adequately reactive products.

Although the reaction products containing halogenohydrin groups have a high affinity for fibre materials of cellulose (cotton) or wool because of their cationic charge, in general incomplete addition onto the fibre takes place when they are used as crosslinking agents in textile printing pastes. Depending on the use form, a proportion of the products enters the effluent in unreacted form, .for example during cleaning of the application rolls, and contributes towards its pollution with organically bonded halogen. The known products furthermore contain secondary components such as 1,3-dichloro-2-propanol (DCP) and 3-chloro-1,2-propanediol (CPD) or corresponding isomers of the two compounds. From the ecological aspect, however, DCP formation should be avoided where possible, or certainly kept as low as possible.

The invention was therefore based on the object of providing storable cationic compounds which are self-crosslinking and film-forming in a weakly acid to alkaline medium, also crosslink the other basic higher molecular weight compounds present in the binder (these contain free amino groups), are at least equivalent to the customary epichlorohydrin resins in their crosslinker action and at the same time contain significantly less organically bonded halogen and less DCP and CPD.

Surprisingly, it has now been found that polyamineepichlorohydrin resins which are obtained by reaction of polyamines with epichlorohydrin, subsequent reaction of the intermediately formed polycondensates containing chlorohydrin groups with inorganic bases and subsequent reaction with inorganic acids and/or carboxylic acids are storage-stable products which are at least equivalent to the known resins in their crosslinker action but have considerably more favourable ecological properties.

The present invention thus relates to a process for pigment printing on fibre materials, which is characterised in that a binder based on A) a basic higher molecular weight compound which is free from halogenohydrin groups, B) a crosslinking agent which is obtained from polyamines and epichlorohydrin, subsequent reaction of the reaction product with inorganic bases and subsequent stabilisation with inorganic acids and/or carboxylic acids and in each Ease preferably contains less than 1.0% by weight of dichloropropanol and/or chloropropanediol in the solid, and if appropriate C) a homo- or copolymer of a vinyl compound is employed.

The binder can contain other customary additives, such as, for example, urea or emulsifiers, additives of a cationic nature, such as, for example, cationic thickeners, being preferred.

In a preferred embodiment, the crosslinking agents B to be used according to the invention are new compounds B* which are obtained from polyamines and epichlorohydrin by subsequent reaction of the reaction product with inorganic bases and subsequent stabilisation with halogen-containing inorganic acids or mixtures of halogen-containing inorganic acids with carboxylic acids.

The new crosslinking agents B* contain less than 1.0% of dichloropropanol and/or chloropropanediol in the solid. Preferably the new crosslinking agents B* are obtained by reaction of B1) a water-soluble, aliphatic polyamine containing primary, secondary and/or tertiary amino or hydroxyl groups, or mixtures thereof, with B2) an epihalogenohydrin or 1,3-dihalogeno-2-hydroxypropane in a molar ratio of 1.0 to 1.5 mol of component B2) per mole of basic nitrogen of component B1), B3) reaction of the products from B1) and B2) with an inorganic base in a molar ratio of 0.1 to 0.8 mol of base per mole of halogenohydrin group in the product of B1) and B2) and B4*) reaction of the basic products obtained according to B3) with a halogen-containing inorganic acid or mixtures of a halogen-containing inorganic acid with a carboxylic acid down to pH values of ≦4.

The new crosslinking agents B* are particularly preferably obtained by reaction of B1) a water-soluble polyamine of the formula (I) or (II), or mixtures thereof

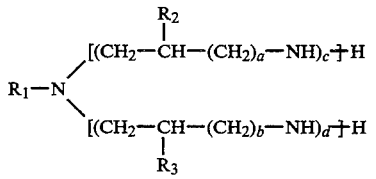

(I)

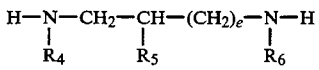

(II)

wherein $R_1$, $R_4$ and $R_6$ independently of one another represent hydrogen or a $C_1$–$C_5$-alkyl radical which is optionally substituted by hydroxyl or amino, $R_2$, $R_3$ and $R_5$ independently of one another represent hydrogen, methyl or ethyl, a, b and e independently of one another represent an integer from 0 to 4 and c and d independently of one another represent an integer from 1 to 6, and/or a poly(alkyleneimine) prepared by polymerisation of 1,2-alkyleneimines with B2) an epihalogenohydrin or 1,3-dihalogeno-2-hydroxypropane in a molar ratio of 1.0 to 1.5 mol, preferably 1.0 to 1.2 mol, of component B2) per mole of basic nitrogen of component B1), and B3) reaction of the products from B1) and B2) with an inorganic base in a molar ratio of 0.1 to 0.8 mol, preferably 0.2 to 0.6 mol, of base per mole of halogenohydrin group of the product from B1) and B2) and B4*) reaction of the basic products obtained according to B3) with hydrochloric acid or mixtures of hydrochloric acid with formic acid and/or acetic acid down to pH values of ≦4, preferably 2 to 4.

The new crosslinking agents B* are furthermore particularly suitable for the treatment of paper and paper-like materials, in particular for the wet strength treatment thereof.

A preferred process for pigment printing on fibre materials is characterised in that a binder based on A) a basic polyamidoamine B) a crosslinking agent which is obtained by reaction of B1) a water-soluble, aliphaticpolyamine containing primary, secondary and/or tertiary amino or hydroxyl groups, or mixtures thereof, with B2) an epihalogenohydrin or 1,3-dihalogeno-2-hydroxy-propane in a molar ratio of 1.0 to 1.5 mol of component B2) per mole of basic nitrogen of component B1), B3) reaction of the products from B1) and B2) with an inorganic base in a molar ratio of 0.1 to 0.8 mol of base per mole of halogenohydrin group in the product from B1) and B2) and B4) reaction of the basic products obtained according to B3) with an inorganic acid and/or a carboxylic acid down to pH values of ≦4, and if appropriate C) a homo- or copolymer of a vinyl compound, is employed.

Suitable basic higher molecular weight compounds A which are free from halogenohydrin groups are, for example, basic polyamidoamines.

Basic polyamidoamines are polycondensates which are obtained from $C_2$- to $C_{10}$-dicarboxylic acids and polyamines having at least two amino groups which are capable of amide formation and at least one other primary, secondary or tertiary amino group, and have molecular weights ($\overline{M}_w$) of >500. These polyamidoamines are obtainable, for example, by condensation of $C_2$- to $C_{10}$-dicarboxylic acids, preferably adipic acid, and the abovementioned polyamines, preferably diethylenetriamine, in a molar ratio of 1:0.90 to 1:1.10 at 180°–220° C. The polyamide is preferably employed as an aqueous, in particular approximately 50% by weight, solution.

The crosslinking agents B are cationic polycondensates and have a molecular weight of preferably 1,000 to 200,000, in particular 2,000 to 100,000.

In a preferred embodiment, a binder based on 100 parts by weight of A), 50–500 parts by weight of B) and 100–1,000 parts by weight of C) is used.

A particularly preferred process for pigment printing on fibre materials is characterised in that crosslinking agents B) which are obtained by reaction of B1) a water-soluble polyamine of the formula (I) or (II), or mixtures thereof

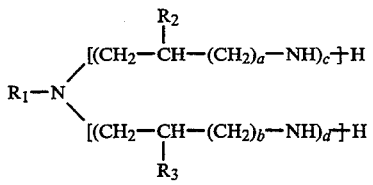

(I)

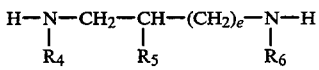

(II)

wherein $R_1$, $R_4$ and $R_6$ independently of one another represent hydrogen or a $C_1$–$C_5$-alkyl radical which is optionally substituted by hydroxyl or araino, $R_2$, $R_3$, and $R_5$ independently of one another represent hydrogen, methyl or ethyl, a, b and e independently of one another represent an integer from 0 to 4 and c and d independently of one another represent an integer from 1 to 6, and/or a poly(alkyleneimine) prepared by polymerisation of 1,2-alkyleneimines with B2) an epihalogenohydrin or 1,3-dihalogeno-2-hydroxy-propane in a molar ratio of 1.0 to 1.5 mol, preferably 1.0 to 1.2 mol, of component B2) per mole of basic nitrogen of component B1), and B3) reaction of the products from B1) and B2) with an inorganic base in a molar ratio of 0.1 to 0.8 mol, preferably 0.2 to 0.6 mol, of base per mole of halogenohydrin group of the product from B1) and B2) and B4) reaction of the basic products obtained according to B3) with a halogen-containing inorganic acid and/or a carboxylic acid down to pH values of ≦4, preferably 2 to 4, are employed.

The aqueous solutions of the crosslinking agent have a viscosity of 15 to 400 mPas, preferably 20 to 300 mPas, at 25° C. at a solids content of 5 to 35% by weight, preferably 10 to 30% by weight.

The crosslinking agents B) and B*) are preferably prepared in an aqueous medium. However, it is also possible to use other polar solvents, such as ethylene glycol, diethylene glycol, triethylene glycol, polyethylene glycol, glycerol, isopropanol, ethanol, methanol, tert.-butanol, dimethylformamide or mixtures thereof with water.

The starting components B1) and B2) are first reacted with one another by stirring 15 to 60% by weight solutions, preferably 20 to 50% by weight solutions, in water or other abovementioned polar solvents or mixtures thereof with water with one another at a temperature of 25° to 95° C., preferably 40° to 80° C., for 20 minutes to 20 hours. At the latest when the solution viscosity of the mixture has reached 300 mPa.s (25° C.), addition of solvent is necessary, in order to prevent premature crosslinking.

The mixture is then already brought to pH values of 8 to 14, preferably 8.5 to 12, with the aid of an inorganic base according to B3) during the polycondensation at temperatures of 15 to 95° C., preferably 20° to 70° C. It is preferable here for the mixture to be diluted to a solids content of 15 to 30% before addition of the base.

Particularly suitable inorganic bases are: NaOH, KOH, LiOH, $Ca(OH)_2$, $Ba(OH)_z$, $NH_3$, $Na_2CO3$, $K_2CO_3$ and $CaCO_3$, particularly preferably $NH_3$, NaOH and/or KOH.

The reaction mixture is then stirred for 10 minutes to 10 hours, preferably 15 minutes to 8 hours, at 15° to 80° C., preferably 20° to 70° C., while maintaining basic pH values, until the mixture has a solution viscosity of 15 to 400 mPa.s (25° C.).

Cyclisation of the halogenohydrin groups present in the polycondensate to form epoxy groups and salt formation can take place during this operation.

To interrupt the polycondensation, acid or an acid derivative according to B4) or B4*) is then added in an amount such that the pH of the solution is ≦4, preferably 2.0 to 4.

Particularly suitable acids and acid derivatives are:

1. Mineral acids or acid derivatives of these acids, such as amidosulphonic acid, sulphurous acid, hydrochloric acid, nitric acid and, in particular, sulphuric and phosphoric acid, particularly preferably hydrochloric acid, 2. Mono- or polycarboxylic acids, which optionally contain hydroxyl groups, or derivatives of these acids, such as acetic acid, acetic anhydride, propionic acid, oxalic acid, malonic acid, succinic acid, glutaric acid, adipic acid, maleic acid, formic acid and citric acid, particularly preferably formic acid and acetic acid, or mixtures thereof.

The solids content of the finished products is then adjusted to the desired solids content by removing some of the solvent in vacuo or by addition of solvent.

Polyamines (I) which may be mentioned are: diethylenetriamine, triethylenetetramine, tetraethylenepentamine, pentaethylenehexamine, hexaethyleneheptamine, heptaethyleneoctamine, dipropylenetriamine, tripropylenetetramine, methyl-bis-(3-aminopropyl)-amine, ethyl-bis-(3-aminopropyl)-amine, 2-hydroxy-ethyl-bis-(3-amino-propyl)-amine, dihexamethylenetriamine or mixtures thereof, preferred polyamines I being diethylenetriamine and methyl-bis(3-aminopropyl)amine.

Diamines (II) which may be mentioned are: ethylenediamine, N-(2-hydroxyethyl)-ethylenediamine, N,N'-dimethyl-ethylenediamine, 1,2-diaminopropane, 1,3-diaminopropane, N,N'-dimethyl-1,3-diaminopropane, N-methyl-1,3-diamino-propane and 1,6-diaminohexane, preferably ethylenediamine.

The preferred 1,2-alkyleneimine B1) is ethyleneimine. Preferred examples of B2) are epichlorohydrin, epibromohydrin and 1,3-dichloro-2-hydroxy-propane.

It is possible to prepare crosslinking agents of widely varying viscosities by suitable choice of the pH, the concentration, the temperature and the reaction time, the maximum viscosity being limited by the solubility of the products, since premature crosslinking of the condensation products must be avoided. The condensation reactions can be interrupted at any time by addition of acid. Stabilisation of the condensation products simultaneously occurs by this addition of acid. The condensation products react in the alkaline pH range or on drying out or on heating to temperatures of about 100° C. to undergo self-crosslinking, water-insoluble products being formed.

The crosslinking agents mentioned have film-forming properties and not only have a self-crosslinking action but also crosslink the other basic higher molecular weight compounds which are free from halogenohydrin groups and are contained in the binder. They are therefore simultaneously (pigment) binders and crosslinking agents.

The use of such crosslinking agents which simultaneously also function as (pigment) binders has the advantage over most of the other crosslinking agents that, because of their intrinsic crosslinkability, they can also be used in overdosed amounts. If an overdose of the usual water-soluble crosslinking agents which are non-volatile during drying (100° to 150° C.) is used, these are retained partly in unchanged forth in the film after fixing and thus cause a lower resistance to water. In spite of this disadvantage, however, a small overdose is preferably used in practice, since a deficiency of crosslinking agents—even if only low—would manifest itself even more unfavourably. Nevertheless, in pigment printing it is advisable not to allow the overdose of crosslinking agent to become too high in certain combinations, since otherwise cloudings in the colour shade can sometimes occur.

When used on the fibre material, the crosslinking agents also display the great advantage over most other crosslinking agents that on the one hand they crosslink very rapidly during drying of the print, but on the other hand they are practically stable in acid aqueous solution up to temperatures of about 50° C., which means that an extremely long storage life of the printing pastes is achieved.

Since these reactive polycondensates have a higher intrinsic viscosity than other crosslinking agents, a thickener can be dispensed with in the printing pastes, which gives rise to a better handle and a better wash-fastness of the printed textiles.

If appropriate, the binders contain a homo- or copolymer of a vinyl compound C), preferably a vinyl acetate, methacrylic acid, methacrylic acid alkyl ester (methyl, ethyl or butyl ester), acrylic acid, acrylic acid alkyl ester (methyl, ethyl or butyl ester), acrylonitrile, dichloroethene, butadiene, styrene, vinylpyrrolidone, vinylpyridine, vinyl alkyl ether (vinyl methyl ether) or vinyl alcohol homopolymer or copolymer or mixtures thereof. Such (co)polymers are knowns, for example, from German Patent Specification 908,133 and French Patent Specification 1,044,736. A copolymer of butyl acrylate, 1,1-dichloroethene and if appropriate methacrylic acid is particularly preferably employed.

Clear, preferably aqueous solutions which are storage-stable for months, even at a high solids content of up to 35% by weight, and are outstandingly suitable for use as crosslinking agents for textile printing pastes are obtained in the manner described under conditions which are industrially simple and easy to handle.

The process is preferably used for pigment printing on textiles (woven fabric and knitted fabric), in particular of cotton or cellulose or blended spun yarns with synthetic fibres, for example polyamide, polyester or polyacrylonitrile; however, it can also be used for printing other fibre materials, for example paper, in particular for printing wallpaper.

The process according to the invention is carried out in practice in a manner known per se, for example by preparing a printing paste containing the basic polyamidoamine as well as the pigment and the crosslinking agent and if appropriate the polyvinyl compound, printing the fibre material with this printing paste on a printing unit and then carrying out the condensation reaction, if appropriate at elevated temperature.

The printing paste can contain other customary additives, for example acids (acetic acid), urea, emulsifiers, thickeners (heavy benzine, hydroxyethylcellulose, cationic swelling thickeners) and creaseproofing, stiffening, softening or matting agents.

Possible pigments are all the customary organic or inorganic pigments.

The prints can be fixed, for example, by storage at room temperature for 14 days or by heat treatment at 90°–150° C. (residence time of a few minutes), by neutral stewing or by means of an alkaline bath (3–5 g of NaOH of 38° Bé per liter) at 50°–80° C.

The resulting prints are distinguished by good fastnesses, without the substrate being impaired (soft handle).

The crosslinking agents employed and therefore also the textile printing pastes contain (before the fixing) considerably smaller amounts of organically bonded halogen and less 1,3-dichloro-2-propanol (DCP) and 3-chloro-1,2-propanediol (CPD) and isomers thereof, and are considerably more advanced from ecological aspects.

The organic chlorine content of the crosslinking agents is therefore decreased by 60 to 95% compared with the prior art. The DCP content and the CPD content are decreased by up to 99.9% compared with the prior art. The percentages in the following Examples are, if not otherwise stated, percentages by weight.

EXAMPLE 1

Preparation of the crosslinking agent 5.06 kg of N-methyl-N,N-bis(3-aminopropyl)amine are dissolved in 36.59 kg of $H_2O$. 10.63 kg of epichlorohydrin are pumped into the initial mixture at an initial temperature of 20° to 25° C. in the course of 45 to 90 minutes, while stirring, such that the internal temperature remains below 35° C. The temperature is kept below 35° C. by cooling. The mixture is subsequently stirred at 30° C. to 35° C. for a further 30 minutes. It is then stirred at 55° C. for 90 minutes. 34.85 kg of $H_2O$ are then added and a pH of 10 is established with a 45% aqueous NaOH solution. The mixture is stirred at pH 10 and 40° C. until the desired viscosity is reached. It is then brought to pH 2.5 to 3 with 4.89 kg of concentrated HCl and 1.66 kg of acetic acid. If appropriate, the product is briefly degassed or diluted with $H_2O$, depending on the solids content found.

| | |
|---|---|
| Solids content: | 20.0% |
| pH: | 2.7 |
| Viscosity (25° C.): | 50 mPa · s |
| Organic chlorine content: | 1.0% by weight |
| 1,3-Dichloro-2-propanol content: | 0.05% |
| 3-Chloro-1,2-propanediol content: | 0.02% |

EXAMPLE 2

Preparation of a crosslinking agent 509 g of N-methyl-N,N-bis(3-aminopropyl)amine are dissolved in 3567 g of $H_2O$ under a nitrogen atmosphere. 1020 g of epichlorohydrin are added dropwise at 20° to 25° C. The mixture is subsequently stirred at 30° C. for 30 minutes and heated at 55° C. for 90 minutes. 3397 g of $H_2O$ are then added and the pH is brought to 10 with NaOH. The mixture is stirred at pH 10° and 40° C. for about 100 minutes, until the desired viscosity is reached. 289 g of concentrated $H_2SO_4$ are then added, so that a pH of 2.5 to 3.0 results.

| | |
|---|---|
| Solids content: | 20.0% |
| pH: | 2.6 |
| Viscosity (25° C.): | 45 mPa · s |
| Organic chlorine content: | 0.95% by weight |
| 1,3-Dichloro-2-propanol content: | <0.01% |
| 3-Chloro-1,2-propanediol content: | <0.005% |

EXAMPLE 3

Example 1 was repeated with the corresponding molar amounts of diethylenetriamine instead of the amine described in Example 1.

| | |
|---|---|
| Solids content: | 20.0% |
| pH: | 2.5 |
| Viscosity (25° C.): | 45 mPa · s |
| Organic chlorine content: | 0.25% by weight |
| 3-Chloro-1,2-propanediol content: | 0.003% |
| 1,3-Dichloro-2-propanol content: | 0.004% |

EXAMPLE 4

A copolymer latex of 70 parts by weight of 1,1-dichloroethene and 30 parts by weight of butyl acrylate is prepared by polymerisation of 100 parts by weight of the monomer mixture in 150 parts by weight of the 5% aqueous solution of the Na salt of commercially available sulphonated long-chain paraffin hydrocarbons (Mersolat) at 20° C. in a pressure autoclave, with addition of 2 ccm of 1N $H_2SO_4$ and 0.6 part by weight of sodium paraffinsulphinate (Mepasin sulphinate), until conversion of the monomers is complete. After a polymerisation time of 15 hours, it shows a polymer content of 39.5%.

100–200 parts by weight of this latex are mixed with 5 parts by weight of a reaction product of 2 mol of styrene and 1 mol of phenol with subsequent oxyethylation (about 13.5 ethylene oxide units) and 40–60 parts by weight of a 50% aqueous solution of a polyamide prepared by condensation of 1 mol of adipic acid with 1.05 mol of diethylenetriamine at 180°–200° C. 785–615 parts by weight of a heavy benzine emulsion consisting of 24.4–18.8 per cent by weight of water, 0.6–1.2 per cent by weight of emulsifier (ethoxylated lauryl alcohol) and 75–80 per cent by weight of heavy benzine (characterised by a boiling range of 140°–200° C., preferably 160°–190° C., ignition temperature >30° C.) are added and the mixture is brought to pH 4.3–5.0 with 20–30 parts by weight of acetic acid. 50 to 100 parts by weight of a 20% solution of a polycondensate from Example 1 obtained from epichlorohydrin and bis-(3-aminopropyl)-methylamine are also added. Addition of 20 to 40 parts by weight of urea ensures good printing properties of such printing pastes. Finally, up to 40 parts by weight, depending on the depth of colour, of a copper phthalocyanine pigment paste (C.I. Pigment Blue 15) are added.

EXAMPLE 5

The batch corresponds to that of Example 4, but instead of the product from Example 1, 50 to 100 parts by weight of the crosslinking agent from Example 2 are employed.

EXAMPLE 6

The batch corresponds to that of Example 4, but instead of the product from Example 1, 50 to 100 parts by weight of the crosslinking agent from Example 3 are employed.

EXAMPLE 7

The batch corresponds to that of Example 4, but instead of heavy benzine, 300–400 parts by weight of a 4% aqueous hydroxyethyethylcellulose solution are employed.

EXAMPLE 8

The batch corresponds to that of Example 4, but instead of heavy benzine, about 70 parts by weight of a cationic synthetic thickener with an active substance content of about 30% are employed.

EXAMPLE 9

The batch corresponds to that of Example 4, but instead of the phthalocyanine pigment, up to 40 parts by weight of an azo pigment (C.I. Pigment Yellow 83 or C.I. Pigment Red 146) or up to 60 parts by weight of carbon black or up to 400 parts by weight of titanium dioxide pigment are employed.

EXAMPLE 10

The batch corresponds to that of Example 4; however, instead of the phthalocyanine pigment, up to 200 parts by weight of titanium dioxide pigment or up to 80 parts by weight of an azo pigment (C.I. Pigment Yellow 83 or C.I. Pigment Orange 34) or up to 80 parts by weight of a phthalocyanine pigment (C.I. Pigment Blue 15 or C.I. Pigment Green 7) are employed.

EXAMPLE 11

The printing pastes of Examples 4 to 10 are applied according to a pattern to woven or knitted textiles of cotton by the rotary screen printing process. The prints are dried at 140° C. for 4 minutes. Prints with good use properties coupled with a soft handle are obtained.

EXAMPLE 12

The printing pastes according to Examples 4 to 10 are applied according to a pattern to textiles of a woven or knitted nature of cotton, cellulose or blended spun yarns with synthetic fibres of polyamide, polyester or polyacrylonitrile by the screen printing or roller printing process.

After appropriate fixing by storage at room temperature for 14 days, by heat treatment at 90° to 150° C., by neutral steaming or by means of an alkaline bath (3 to 5 g of NaOH of 38° Bé per liter) at 50° to 80° C., prints with good use properties coupled with a soft handle are obtained.

We claim:

1. A process for pigment printing on fibre materials in which a pigment is fixed to a fibre material with a binder, wherein said binder is a binder comprising:

A) a basic polyamidoamine and

B) a crosslinking agent which is obtained by reaction of a polyamine with epihalogenohydrin or 1,3-dihalogeno-2-hydroxy-propane, followed by reaction with an inorganic base and further followed by stabilization with an acid selected from the group consisting of inorganic acids, carboxylic acids and mixtures thereof.

2. The process of claim 1, in which said binder additionally comprises

C) a homo- or copolymer of a vinyl compound selected from the group consisting of vinyl acetate, methacrylic acid, methacrylic acid alkyl ester, acrylic acid, acrylic acid alkyl ester, acrylonitrile, dichloroethane, butadiene, styrene, vinylpyrrolidone, vinylpyridine, vinyl alkyl ether, vinyl alcohol and mixtures thereof.

3. The process of claim 1, wherein said crosslinking agent is obtained by reaction of B1) a water-soluble, aliphatic polyamine containing one or more groups selected from the group consisting of primary, secondary, and tertiary amino and hydroxyl groups, and a mixture thereof, with B2) an epihalogenohydrin or 1,3-dihalogeno-2-hydroxy-propane in a molar ratio of 1.0 to 1.5 mol of component B2) per mole of primary, secondary, and tertiary amino groups of component B1), B3) reaction of the products from B1) and B2) with an inorganic base in a molar ratio of 0.1 to 0.8 mol of base per mole of halogenohydrin group in the product from B1) and B2) and B4) reaction of the products obtained according to B3) with an acid selected from the group consisting of inorganic acid and carboxylic acid down to pH values of ≦4.

4. The process of claim 1, in which said crosslinking agent is obtained by reaction of B1) a water-soluble aliphatic polyamine containing one or more groups selected from the group consisting of primary, secondary, and tertiary amino and hydroxyl groups, and a mixture thereof, with B2) an epihalogenohydrin or 1,3-dihalogeno-2-hydroxy-propane in a molar ratio of 1.0 to 1.5 mol of component B2) per mole of primary, secondary, and tertiary amino groups of component B1), B3) reaction of the products from B1) and B2) with an inorganic base in a molar ratio of 0.1 to 0.8 mol of base per mole of halogenohydrin group in the product from B1) and B2) and B4) reaction of the products obtained according to B3) with an acid selected from the group consisting of inorganic acid and carboxylic acid down to pH values of ≦4, and C) a homo- or copolymer of a vinyl compound selected from the group consisting of vinyl acetate, methacrylic acid, methacrylic acid alkyl ester, acrylic acid, acrylic acid alkyl ester, acrylonitrile, dichloroethene, butadiene, styrene, vinylpyrrolidone, vinylpyridine, vinyl alkyl ether, vinyl alcohol and mixtures thereof.

5. The process of claim 1, in which said crosslinking agent B) is obtained by reaction of B1) a water-soluble polyamine of the formula (I) or (II), or mixtures thereof

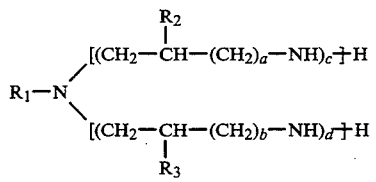

(I)

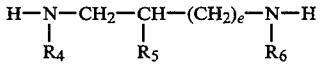

(II)

wherein $R_1$, $R_4$ and $R_6$ independently of one another represent hydrogen, an unsubstituted $C_1$–$C_5$-alkyl radical or a $C_1$–$C_5$-alkyl radical which is substituted by hydroxyl or amino, $R_2$, $R_3$ and $R_5$ independently of one another represent hydrogen, methyl or ethyl, a, b and e independently of one another represent an integer from 0 to 4 and c and d independently of one another represent an integer from 1 to 6, with B2) an epihalogenohydrin or 1,3-dihalogeno-2-hydroxy-propane in a molar ratio of 1.0 to 1.5 mol of component B2) per mole of primary, secondary and tertiary amino groups of component B1), and B3) reaction of the products from B1) and B2) with an inorganic base in a molar ratio of 0.1 to 0.8 mol, of base per mole of halogenohydrin group of the product from B1) and B2) and B4) reaction of the products B3) with an acid selected from the group consisting of halogen-containing inorganic acid and carboxylic acid down to pH values of ≦4.

6. The process of claim 1, in which the cross-linking agent B) is obtained by reaction of B1) a water-soluble polyamine of the formula (I) or (II), or mixtures thereof

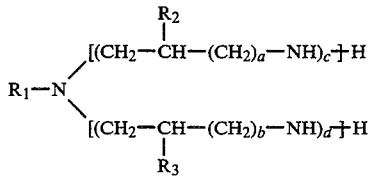

(I)

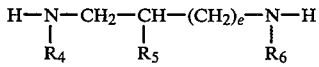

(II)

wherein $R_1$, $R_4$ and $R_6$ independently of one another represent hydrogen, an unsubstituted $C_2$–$C_5$-alkyl radical or a $C_2$–$C_5$-alkyl radical which is substituted by hydroxyl or amino, $R_2$, $R_3$ and $R_5$ independently of one another represent hydrogen, methyl or ethyl, a, b and e independently of one another represent an integer from 0 to 4 and c and d independently of one another represent an integer from 1 to 6, and/or a poly(alkyleneimine) prepared by polymerization of 1,2-alkyleneimines with B2) an epihalogenohydrin or 1,3-dihalogeno-2-hydroxy-propane in a molar ratio of 1.0 to 1.5 mol of component B2) per mole of primary, secondary and tertiary amino groups of component B1), and B3) reaction of the products from B1) and B2) with an inorganic base in a molar ratio of 0.1 to 0.8 mol of base per mole of halogenohydrin group of the product from B1) and B2) and B4) reaction of the products B3) with an acid selected from the group consisting of halogen-containing inorganic acid and carboxylic acid down to pH values of ≦4.

7. The process of claim 5, in which in B2) epihalogenohydrin or 1,3-dihalogeno-2-hydroxy-propane is used in a molar ratio of 1.0 to 1.2 mole per mole of primary, secondary and tertiary amino groups of component B1).

8. The process of claim 5, in which in B3) the inorganic base is used in a molar ratio of 0.2 to 0.6 mole per mole of halogenohydrin group of the product from B1) and B2).

9. The process of claim 5, in which in B4) the products B3) are reacted with the acid down to pH values of 2 to 4.

10. The process of claim 6, in which in B2) epihalogenohydrin or 1,3-dihalogeno-2-hydroxy-propane is used in a molar ratio of 1.0 to 1.2 mole per mole of primary, secondary and tertiary groups of component B1).

11. The process of claim 6, in which in B3) the inorganic base is used in a molar ratio of 0.2 to 0.6 mole per mole of halogenohydrin group of the product from B1) and B2).

12. The process of claim 6, in which in B4) the products B3) are reacted with the acid down to pH values of 2 to 4.

13. The process of claim 1, in which the crosslinking agent B) is employed as an aqueous solution having a viscosity of 15 to 400 mPas at 25° C. at a solids content of 5 to 35% by weight.

14. The process of claim 1, in which the basic polyamidoamine A) used is a condensation product which is obtained from a $C_2$- to $C_{10}$-dicarboxylic acid and polyamines which have at least 2 primary or secondary amino groups, said polyamidoamine having a molecular weight ($M_W$) of $>500$.

15. The process of claim 1, in which the fibre materials are textiles.

16. The process of claim 1, in which the fibre materials are those of cellulose.

17. A process according to claim 1, in which a pigment is fixed to a fibre material with a binder, wherein said binder is a binder wherein:

A) the basic polyamidoamine is a condensation product of adipic acid and diethylenetriamine, B) the crosslinking agent is a polycondensate obtained from epichlorohydrin and bis-(3-aminopropyl)-methylamine, and the fibre material is cotton.

18. A process according to claim 17, in which said binder additionally comprises a copolymer of 1,1-dichloroethene and butyl acrylate.

* * * * *